US010487776B2

(12) United States Patent
Ehmann et al.

(10) Patent No.: US 10,487,776 B2
(45) Date of Patent: Nov. 26, 2019

(54) PISTON FOR AN INTERNAL COMBUSTION ENGINE

(71) Applicant: Mahle International GmbH, Stuttgart (DE)

(72) Inventors: Frank Ehmann, Ludwigsburg (DE); Thomas Hettich, Markgroeningen (DE); Sebastian Mangold, Stuttgart (DE); Aziz Goezcue, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/747,761

(22) PCT Filed: Jul. 19, 2016

(86) PCT No.: PCT/EP2016/067178
§ 371 (c)(1),
(2) Date: Jan. 25, 2018

(87) PCT Pub. No.: WO2017/016934
PCT Pub. Date: Feb. 2, 2017

(65) Prior Publication Data

US 2018/0216570 A1 Aug. 2, 2018

(30) Foreign Application Priority Data

Jul. 30, 2015 (DE) ..... 10 2015 214 512

(51) Int. Cl.
*F02F 3/22* (2006.01)
*F02B 23/06* (2006.01)
*F02F 5/00* (2006.01)

(52) U.S. Cl.
CPC ..... *F02F 3/22* (2013.01); *F02B 23/0672* (2013.01); *F02F 5/00* (2013.01)

(58) Field of Classification Search
CPC ..... F02F 3/22; F02F 5/00; F02B 23/0672
See application file for complete search history.

(56) References Cited

U.S. PATENT DOCUMENTS 4,428,330 A 1/1984 Shimizu
9,382,869 B2 7/2016 Freidhager
(Continued)

FOREIGN PATENT DOCUMENTS

CN 1880748 A 12/2006
DE 1905609 A1 8/1970
(Continued)

OTHER PUBLICATIONS

English abstract for JP-2005036764.
(Continued)

*Primary Examiner* — Jacob M Amick
*Assistant Examiner* — Charles Brauch
(74) *Attorney, Agent, or Firm* — Fishman Stewart PLLC

(57) ABSTRACT

A piston for an internal combustion engine including a piston crown and a combustion chamber recess recessed therein, the combustion chamber recess including a recess edge. The piston may also include a ring groove for receiving a piston ring. The piston may further include a cooling duct having a smaller spacing from the piston crown than that of a flank of the ring groove, the cooling duct defining a minimum spacing from the piston crown at a first location, and a minimum spacing from the combustion chamber recess at a second location. The cooling duct may have a rounded portion between the first location and the second location. The cooling duct may have a maximum spacing from the recess edge at a third location. The rounded portion may have a rounding radius defined at least at the third location that is greater than 4% of a piston diameter.

19 Claims, 1 Drawing Sheet

(56) References Cited

U.S. PATENT DOCUMENTS

| | | | | |
|---|---|---|---|---|
| 2008/0078339 | A1 | 4/2008 | Obermeier | |
| 2012/0160204 | A1* | 6/2012 | Scharp | F02F 3/003 123/193.6 |
| 2014/0190010 | A1* | 7/2014 | Baberg | B23P 15/10 29/888.04 |
| 2014/0260957 | A1* | 9/2014 | Hempston | F02F 3/00 92/172 |

FOREIGN PATENT DOCUMENTS

| | | | |
|---|---|---|---|
| DE | 2828237 | B2 | 6/1980 |
| DE | 3832022 | C1 | 9/1989 |
| DE | 102004056769 | A1 | 6/2006 |
| DE | 102008002571 | A1 | 12/2009 |
| DE | 102010054831 | A1 | 6/2011 |
| DE | 102010043124 | A1 | 5/2012 |
| GB | 2024321 | B | 10/1982 |
| JP | 2005036764 | A | 2/2005 |

OTHER PUBLICATIONS

English abstract for DE-102010043124.
English abstract for DE-102010054831.
English abstract for CN-1880748.

* cited by examiner

PISTON FOR AN INTERNAL COMBUSTION ENGINE

CROSS-REFERENCE TO RELATED APPLICATIONS

This application claims priority to International Patent Application No. PCT/EP2016/067178, filed on Jul. 19, 2016, and German Patent Application No. DE 10 2015 214 512.3, filed on Jul. 30, 2015, the contents of both of which are hereby incorporated by reference in their entirety.

TECHNICAL FIELD

The present invention relates to a piston for an internal combustion engine having a piston crown and a combustion chamber recess which is recessed therein.

BACKGROUND

DE 28 28 237 C3 has disclosed a piston of the generic type for an internal combustion engine having a piston crown and a combustion chamber recess which is recessed therein, and having at least one ring groove for receiving a piston ring. A cooling duct for cooling the piston is likewise provided.

DE 10 2004 056 769 A1 has disclosed a further piston for an internal combustion engine, having at least one cooling duct which has two sections which are situated at different levels with regard to the height along the piston axis and/or in the radial direction. Here, two or more cooling ducts can be provided, of which at least two are situated at different levels with regard to the height along the piston axis and/or in the radial direction.

DE 10 2008 002 571 A1 has disclosed a further piston for an internal combustion engine having at least one cooling duct which is situated at a low level which is comparatively remote from the piston crown exclusively in the region of at least one inflow and at least one outflow, and is otherwise situated at a consistently higher level which lies closer to the piston crown. In particular, improved cooling of the piston is to be capable of being achieved as a result.

In the case of pistons having a combustion chamber recess which are known from the prior art, comparatively high thermal loadings which can have a long term negative effect occur, in particular, in the region of a recess edge.

SUMMARY

The present invention is therefore concerned with the problem of specifying an improved or at least alternative embodiment for a piston of the generic type, which embodiment is distinguished, in particular, by an increased service life.

According to the invention, said problem is solved by way of the subject matter of independent claim(s). Advantageous embodiments are the subject matter of the dependent claims.

The present invention is based on the general concept of rounding a cooling duct in a piston of an internal combustion engine with a comparatively great radius with respect to a piston crown and a combustion chamber recess, and to achieve an improved notch effect in said region as a result, which notch effect contributes, in particular, to withstanding the high thermal loads which occur in said region in an improved manner.

Here, the piston according to the invention has the above-described piston crown and a combustion chamber recess which is recessed therein, and at least one ring groove for receiving a piston ring, and a cooling duct for cooling the piston. In order for it then to be possible to increase the service life of the piston and also its load-bearing capability, the cooling duct is arranged in such a way that it has a smaller spacing from the piston crown than the at least one ring groove. This means that the cooling duct is arranged completely above the lower flank of the one ring groove or the uppermost of a plurality of (frequently, three) ring grooves. In the present application, only the uppermost ring groove which is closest to the piston crown of a plurality of ring grooves is taken into consideration. In one preferred embodiment, the entire cooling duct is situated above the upper flank of the ring groove which is closest to the piston crown, the directions "above" and "below" relating to the usual installation and operating position of the engine in said description along the piston axis of the piston, and therefore denoting the side which is close to the piston crown and faces the combustion chamber and the side which is remote from the piston crown and faces away from the combustion chamber, respectively. The position close to the piston crown of the cooling duct firstly brings about an improved thermal conduction from the combustion chamber as a result of the vicinity of the cooling duct to the location of the thermal input on the piston crown. Its substantial advantage consists, however, in that the cooling duct is arranged approximately in the center between the piston crown, the combustion chamber recess and the ring groove or ring carrier in a zone with relatively low mechanical stresses, whereas a position further away from the piston crown radially within the uppermost ring groove in accordance with the prior art leads to stress concentrations between the ring groove and the combustion chamber recess.

Moreover, the cooling duct has a minimum spacing from the piston crown at a first location and a minimum spacing from the combustion chamber recess at a second location, and is additionally of rounded configuration between the first location and the second location, a third location with a maximum spacing from a recess edge which forms the transition from the piston crown into the combustion chamber recess being situated between the first and the second location. Here, the spacing of the third location from the recess edge is measured at the third location radially, that is to say at a right angle with respect to the cooling duct surface. According to the invention, the cooling duct has a particularly great rounded portion in a region of its surface which faces the recess edge, the rounding radius at least at the third location being greater than 4%, particularly preferably greater than 5% of the piston diameter. The great rounded portion preferably extends over a relatively wide region of the cooling duct surface, which region has a rounding radius of more than 4% of the piston diameter continuously from the second location as far as the third location.

In one particularly preferred embodiment, the rounded portion begins below the second location, that is to say in a manner which begins further away from the piston crown than the minimum spacing from the combustion chamber recess, and extends beyond the third location through at least three radii R1, R2 and R3 which adjoin one another, are in each case greater than 4% of the piston diameter and, as a result, make a comparatively great rounded portion of the cooling duct possible in the region between the combustion chamber recess and the piston crown. The rounded portion according to the invention can be provided by way of one or more circular arcs R1, R2, R3 which adjoin one another, or else can have convex, continuously curved shapes, as long as the abovementioned minimum radii are maintained throughout. The great rounded portion can extend as far as the first location or beyond the latter, or can preferably end in the region between the third location and the first location. In general, the notch effect can be reduced, in particular, in that part of the cooling duct surface which faces the recess edge by way of the comparatively great rounded portion, and therefore the load-bearing capability of the piston according to the invention can be increased.

In one advantageous development of the solution according to the invention, the first radius R1 is greater than the second radius R2 and/or smaller than the third radius R3. As a result, the rounded portion of the cooling duct can be guided over the third location with a comparatively great radius, as a result of which the notch effect can be influenced in a particularly positive manner in said region. Moreover or as an alternative, the second radius can be smaller than the third radius, as a result of which the first and second radius R1, R2 which are already comparatively great are increased once more and, as a result, the rounded portion of the cooling duct in said region and toward the third location is particularly advantageous.

In a further advantageous embodiment of the solution according to the invention, a fourth radius R4 is provided which describes the rounded portion, adjoins the third radius R3, reaches as far as the first location, but is smaller than the radii R1 and R2 and, in particular, is also smaller than the third radius R3. As a result, the cooling duct can be rounded in the manner of an oval in the region of the first location, and can be merged by way of the comparatively small fourth radius which can be, for example, approximately 1.3 mm into the adjoining straight lines, that is to say the non-rounded region of the cooling duct. Said non-rounded region of the cooling duct is required, in particular, for producing the salt core or the sand core.

The first radius R1 is expediently approximately 3.7 mm, the second radius R2 is approximately 3.6 mm, the third radius R3 is approximately 4.4 mm and the fourth radius R4 is approximately 1.3 mm, whereas the piston diameter d is approximately 83 mm. In tests, said dimensions have led to a particularly high load-bearing capability of the piston according to the invention, it going without saying that the ratios of the individual radii and of the diameter can be extrapolated correspondingly to larger or smaller pistons and can therefore be adapted to pistons of different size. The ratios which lie in said region therefore provide an optimum notch effect for virtually every piston size in the region of the recess edge, on account of the comparatively great radius R3.

In a further advantageous embodiment of the solution according to the invention, the minimum spacing from the piston crown is approximately 3.0 mm, the minimum spacing from the combustion chamber recess being, in addition or as an alternative, at least 2.6 mm and preferably approximately 3.3 mm, whereas the maximum spacing from the recess edge can be approximately 7.1 mm. It can be seen from this that there is a merely small spacing between the cooling duct and the piston crown and between the cooling duct and the combustion chamber recess, in particular in the case of a piston diameter d of 83 mm, which small spacing in turn makes optimum cooling of the piston possible in the region of the first location and the second location.

Whereas, according to the invention, the regions of the cooling duct surface which face the combustion chamber recess, the recess edge and the piston crown are taken into consideration, it has been proven that the shape design of the radially outer region which faces the firing land and of that part of the cooling duct surface which is furthest away from the piston crown has only little influence on the strength conditions, with the result that any desired surface profiles are possible here, which surface profiles can also have smaller radii, edges or concave cooling duct cross sections with projections, without impairing the strength.

In a further advantageous embodiment of the solution according to the invention, a ratio of a height h of the cooling duct to the radius R3 at the third location is defined as follows: $h/R3 \geq 0.6$.

It is particularly preferably the case that $h/R3 \geq 0.65$. As a result, an egg shape of the cooling duct, which shape is improved considerably in comparison with a circular shape, can be achieved, as a result of which a piston which is improved with regard to the service life and the thermal load-bearing capability can likewise be produced.

Further important features and advantages of the invention result from the subclaims, from the drawings and from the associated description of the figures using the drawings.

It goes without saying that the features which are mentioned in the above text and which are still to be described in the following text can be used not only in the respectively specified combination, but rather also in other combinations or on their own, without departing from the scope of the present invention.

Preferred exemplary embodiments of the invention are shown in the drawings and will be described in greater detail in the following description, identical designations relating to identical or similar or functionally identical components.

BRIEF DESCRIPTION OF THE DRAWINGS

In the drawings, in each case diagrammatically.

DETAILED DESCRIPTION

Figure 1:
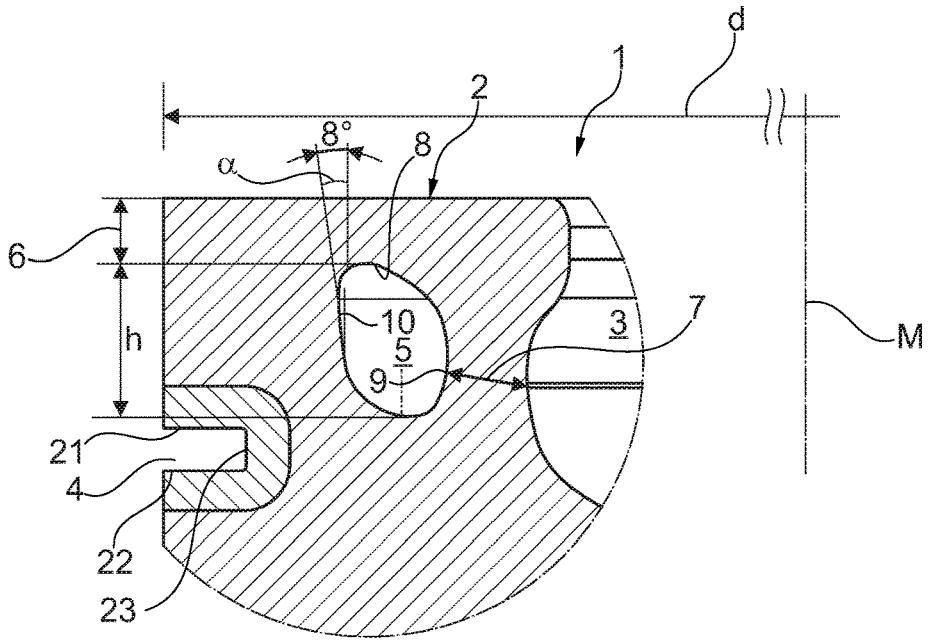
FIG. 1 shows a detailed illustration of a sectional illustration through a piston according to the invention.
Figure 2:
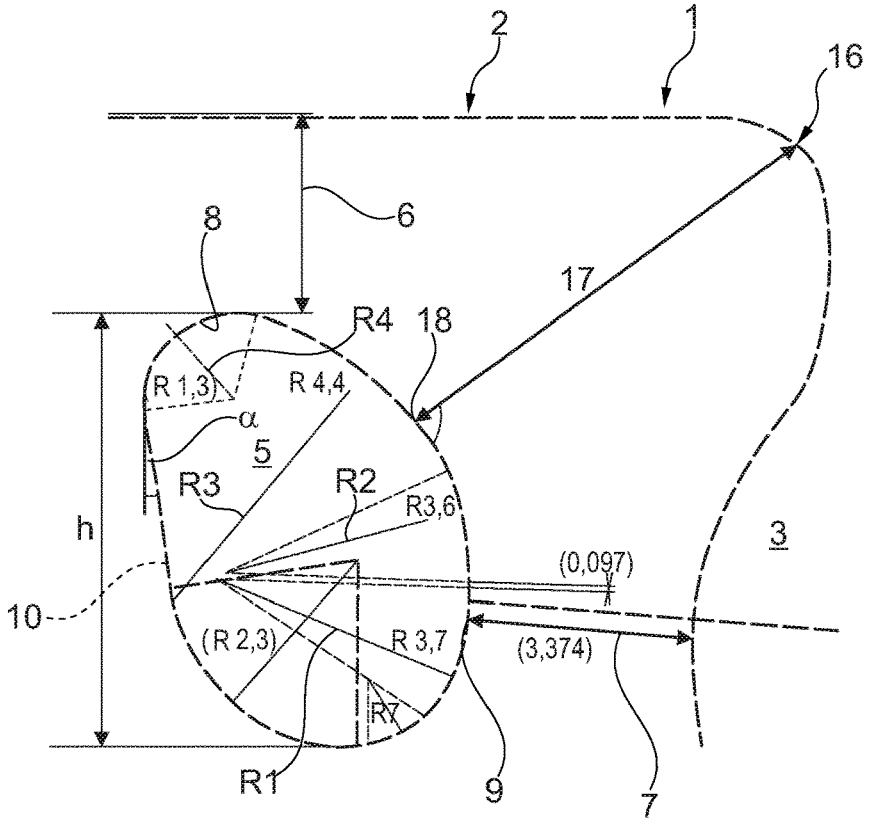
FIG. 2 shows a detailed illustration of the individual radii of the cooling duct of the piston in accordance with FIG. 1.

In accordance with FIGS. 1 and 2, a piston 1 according to the invention of an internal combustion engine (not shown otherwise) has a piston crown 2 and a combustion chamber recess 3 which is recessed therein and forms a recess edge 16 in a transition region to the piston crown 2. At least one ring groove 4 (here, a ring groove 4 which is closest to the piston crown) for receiving a piston ring (not shown) is provided on an outer side of the piston 1. The ring groove 4 has a flank 21 which is close to the piston crown and a flank 22 which is remote from the piston crown, which flanks 21, 22 are arranged in an annular manner and substantially at a right angle with respect to the piston axis 11. A substantially cylindrical groove bottom 23 is situated between the flanks 21 and 22. A cooling duct 5 for cooling the piston 1 is likewise provided.

In order for it then to be possible to increase the thermal load-bearing capability of the piston 1 and therefore also indirectly its service life, the cooling duct 5 has a smaller spacing from the piston crown 2 than the at least one ring groove 4. This means that the cooling duct 5 overall is arranged closer to the piston crown 2 than at least the flank 22, remote from the piston crown, of the one ring groove 4 or the ring groove 4 which is closest to the piston crown. In the preferred exemplary embodiment, the entire cooling duct cross section is closer to the piston crown 2 than that flank 21 of the uppermost ring groove 4 which is close to the piston crown. As a rule, the piston 1 also has further ring grooves (not shown) which are further away from the piston crown. Moreover, the cooling duct 5 has a minimum spacing 6 (cf. FIG. 2) from the piston crown 2 at a first location 8, and has a minimum spacing 7 from the combustion chamber recess 3 at a second location 9. Furthermore, at a third location 18 which faces the recess edge 16 between the first location 8 and the second location 9, the cooling duct 5 has a maximum spacing 17 between the combustion chamber-side piston surface in the region of the recess edge 16 and the cooling duct surface, the spacing 17 being measured at a right angle with respect to the cooling duct surface. Here, the cooling duct 5 is of rounded configuration between the third location 8 and the second location 9, the rounded portion having a radius R3 of more than 5% of the piston diameter at the third location 18. In the region from the second location 9 as far as the third location 18, there is continuously a rounding radius of more than 4% of the piston diameter by way of R3 and a radius R2 which is greater than 4% of the piston diameter d and adjoins R3 without a sharp bend.

In a manner which begins at the second location 9 beyond the third location 18 as far as just before the first location 8, the cooling duct cross section is described by way of at least three radii R1, R2 and R3 which adjoin one another and are in each case greater than 4% of the piston diameter d.

Here, the first radius R1 at, for example, 3.7 mm is greater than the second radius R2 at, for example, 3.6 mm. In addition or as an alternative, the first radius R1 can be smaller than the third radius R3 which can be, for example, 4.4 mm.

If FIG. 2 is considered, it can be seen that a fourth radius R4 is provided which describes a rounded portion of the cooling duct 5, adjoins the third radius R3, reaches as far as the first location 8, and is smaller than the radii R1 and R2 and is also smaller than the radius R3. The fourth radius R4 can be, for example, 1.3 mm. The piston diameter d can have, for example, a value of 83 mm which is customary for passenger car pistons. Here, the abovementioned dimensions are to be protected in particular even in proportion to one another, with the result that pistons 1 having correspondingly enlarged or reduced radii R1, R2, R3, R4 and piston diameters d are also to fall within the invention by way of a positive or negative extrapolation.

If FIG. 2 is once again considered, it can be seen from said figure that the minimum spacing 6 between the first location 8 and the piston crown 2 can be, for example, 3 mm, and the minimum spacing 7 between the second location 9 and the combustion chamber recess 3 can be, for example, 3.3 mm, in particular 3.374 mm, whereas the maximum spacing 17 between the third location 18 and the recess edge 16 can be, for example, 7.1 mm. It goes without saying that said spacings 6, 7 can also be extrapolated correspondingly or adapted and converted in the case of a change in the piston diameter d.

If FIG. 1 is considered, it can be seen that the cooling duct 5 has a height h; a ratio of the height h of the cooling duct 5 to the radius R3 which is present at the third location can be or should be $h/R3 \geq 0.6$ and particularly preferably $h/R3 \geq 0.65$, in order for it to be possible to achieve as low a notch effect as possible and therefore a high thermal load-bearing capability and a long service life. Here, the height h of the cooling duct 5 can be, for example, 6.6 mm.

It can be seen from FIGS. 1 and 2 that the cooling duct 5 has a straight section 10, said straight section 10 being inclined by an angle $\alpha$ of approximately 8° (cf. FIGS. 1 and 2) with respect to the piston axis 11. The production of the piston 1 can be improved by way of a section 10 of this type.

A particularly advantageous embodiment in relation to the thermal load-bearing capability and the long service life of the piston 1 can therefore be achieved by way of the arrangement according to the invention of the cooling duct 5 in relation to the piston crown 2 and the combustion chamber recess 3 and, in particular, also in relation to the arrangement of the ring groove 4 and generally the selection of the radii R1 to R4.

The invention claimed is:

1. A piston for an internal combustion engine, comprising:

a piston crown and a combustion chamber recess recessed therein, the combustion chamber recess including a recess edge;

a ring groove for receiving a piston ring;

a cooling duct having a smaller spacing from the piston crown than that of a flank of the ring groove, the cooling duct defining a minimum spacing from the piston crown at a first location and a minimum spacing from the combustion chamber recess at a second location, wherein the cooling duct has a rounded portion between the first location and the second location;

wherein the cooling duct, as measured at a right angle with respect to a surface of the cooling duct, has a maximum spacing from the recess edge at a third location facing towards the recess edge, and wherein the rounded portion has a rounding radius defined at least at the third location that is greater than 4% of a piston diameter;

wherein the rounded portion is defined by at least three adjoining radii including a first radius, a second radius, and a third radius; and wherein the first radius, the second radius, and the third radius are each greater than 4% of the piston diameter.

2. The piston as claimed in claim 1, wherein the rounding radius at the third location is greater than 5% of the piston diameter.

3. The piston as claimed in claim 1, wherein the rounding radius of greater than 4% of the piston diameter is provided continuously between the second location and the third location.

4. The piston as claimed in claim 1, wherein at least one of:

the first radius is greater than the second radius;

the first radius is smaller than the third radius; and the second radius is smaller than the third radius.

5. The piston as claimed in claim 1, wherein the first radius is approximately 3.7 mm and the second radius is approximately 3.6 mm.

6. The piston as claimed in claim 1, wherein the third radius is approximately 4.4 mm.

7. The piston as claimed in claim 1, wherein the at least three radii further include a fourth radius adjoining the third radius, and extending as far as the first location, wherein the forth radius is smaller than the first radius and the second radius.

8. The piston as claimed in claim 7, wherein the fourth radius is approximately 1.3 mm.

9. The piston as claimed in claim 1, wherein the piston diameter is approximately 83 mm.

10. The piston as claimed in claim 1, wherein at least one of:

the minimum spacing from the piston crown is approximately 3.0 mm;

the minimum spacing from the combustion chamber recess is at least 2.6 mm; and the maximum spacing from the recess edge is approximately 7.1 mm.

11. The piston as claimed in claim 1, wherein a ratio of a height of the cooling duct to the third radius is ≥0.6.

12. The piston as claimed in claim 11, wherein the height of the cooling duct is approximately 6.6 mm.

13. The piston as claimed in claim 1, wherein the flank is a distal flank of the ring groove disposed remote from the piston crown in relation to a proximal flank of the ring groove, and wherein the cooling duct defines an axial extent disposed axially between the piston crown and the proximal flank relative to a piston axis extending perpendicular to the piston crown.

14. A piston for an internal combustion engine, comprising:

a piston crown;

a combustion chamber recess recessed in the piston crown and including a recess edge;

a plurality of ring grooves including a first ring groove and further ring grooves disposed further away from the piston crown than the first ring groove, the first ring groove having a flank disposed proximal to the piston crown and a further flank disposed remote from the piston crown in relation to the flank;

a cooling duct having a smaller spacing from the piston crown than that of the further flank of the first ring groove, the cooling duct defining a minimum spacing from the piston crown at a first location and a minimum spacing from the combustion chamber recess at a second location, wherein the cooling duct has a rounded portion between the first location and the second location;

wherein the cooling duct, as measured at a right angle with respect to a surface of the cooling duct, has a maximum spacing from the recess edge at a third location that faces towards the recess edge, and wherein the rounded portion defines a rounding radius of greater than 4% of a piston diameter at least at the third location;

wherein the cooling duct is disposed axially between the piston crown and the further flank of the first ring groove relative to a piston axis extending perpendicular to the piston crown;

wherein the rounded portion is defined by at least three adjoining radii including a first radius, a second radius, and a third radius;

wherein the first radius, the second radius, and the third radius are each greater than 4% of the piston diameter;

wherein the first radius is greater than the second radius and smaller than the third radius, the first radius defines a first section of the rounded portion, the second radius defines a second section of the rounded portion, and the third radius defines a third section of the rounded portion; and wherein the first section is disposed proximal the second location, the third section is disposed proximal the first location, and the second section is disposed between the first section and the third section.

15. The piston as claimed in claim 14, wherein the first location of the cooling duct has an oval shape disposed circumferentially between the rounded portion and a straight section of the cooling duct, and wherein the oval shape of the first location is defined by a radius that is smaller than the rounding radius of the rounded portion.

16. The piston as claimed in claim 1, further comprising a plurality of further ring grooves disposed further away axially from the piston crown than the ring groove relative to a piston axis extending perpendicular to the piston crown;

wherein the cooling duct is disposed axially between the piston crown and the flank of the ring groove.

17. The piston as claimed in claim 1, wherein the cooling duct has a straight section disposed opposite to the rounded portion circumferentially between the first location and the second location, the straight section extending toward the piston crown and away from the combustion chamber recess at an 8° angle relative to a piston axis extending perpendicular to the piston crown.

18. The piston as claimed in claim 17, wherein the first location has an oval shape disposed circumferentially between the straight section and the rounded portion, and wherein the oval shape of the first location is defined by a radius that is smaller than the rounding radius of the rounded portion.

19. The piston as claimed in claim 1, wherein:

the first radius is greater than the second radius and smaller than the third radius;

the first radii defines a first section of the rounded portion the second radii defines a second section of the rounded portion, and the third radii defines a third section of the rounded portion; and the first section is disposed proximal the second location, the third section is disposed proximal the first location, and the second section is disposed between the first section and the third section.

* * * * *